US007578603B2

(12) United States Patent
Huang et al.

(10) Patent No.: US 7,578,603 B2
(45) Date of Patent: Aug. 25, 2009

(54) ACOUSTIC WAVE INDUCED LIGHT EMITTING GOLF BALL

(76) Inventors: Chang-Hsiu Huang, No. 156, Sec. 1, Yaofong Road, Pusin Township, Changhua County 513 (TW); Wei-Lung Chou, 2F., No. 186, Sec. 3, Chongyang Rd., Sanchong City, Taipei County 241 (TW)

( * ) Notice: Subject to any disclaimer, the term of this patent is extended or adjusted under 35 U.S.C. 154(b) by 62 days.

(21) Appl. No.: 11/889,229

(22) Filed: Aug. 10, 2007

(65) Prior Publication Data

US 2009/0040761 A1 Feb. 12, 2009

(51) Int. Cl.
*F21V 23/04* (2006.01)

(52) U.S. Cl. ..... 362/276; 362/86; 362/394

(58) Field of Classification Search ..... 362/86, 362/253, 276, 394, 802; 181/122; 367/180; 310/311; 473/131
See application file for complete search history.

(56) References Cited

U.S. PATENT DOCUMENTS

| | | | | |
|---|---|---|---|---|
| 5,012,223 | A * | 4/1991 | Griebell et al. | 340/531 |
| 2005/0096157 | A1 * | 5/2005 | Huang | 473/351 |
| 2005/0261083 | A1 * | 11/2005 | Liao | 473/353 |
| 2008/0108454 | A1 * | 5/2008 | Kohnen | 473/351 |

* cited by examiner

*Primary Examiner*—Jong-Suk (James) Lee
*Assistant Examiner*—Julie A Shallenberger
(74) *Attorney, Agent, or Firm*—Rosenberg, Klein & Lee

(57) ABSTRACT

A light emitting golf ball is provided that includes a spherical housing, a fixing container, a light emitting device, a first fitting portion, and a second fitting portion. The light emitting device is disposed in the fixing container and includes an acoustic wave sensor, a controller, one or more light emitting elements and an electricity supplier. When the acoustic wave sensor receives an external acoustic wave signal higher than a predetermined value, it sends out an activating signal to the controller so that at least one light emitting element emits light. This invention is irrelevant to the hitting direction. It has an extremely low defective rate. Furthermore, the product life can be prolonged.

2 Claims, 5 Drawing Sheets

ACOUSTIC WAVE INDUCED LIGHT EMITTING GOLF BALL

BACKGROUND OF INVENTION

1. Field of the Invention

The present invention relates to an acoustic wave induced light emitting golf ball. More particularly, it relates to an acoustic wave induced light emitting golf ball having an acoustic wave sensor. This invention is irrelevant to the hitting direction. It has an extremely low defective rate. Furthermore, the product life can be prolonged.

2. Description of the Prior Art

As shown in FIGS. 1 and 2, a light emitting device 91 is mounted in a conventional light emitting golf ball 90. This light emitting device 91 includes a metal hollow tube 92, a controller 93 (such as a circuit board) and one or more small light bulb 94 (or LED, the light emitting diode). There is a spring type vibration sensor 95 disposed inside the metal hollow tube 92.

Referring to FIGS. 3 and 4, if the spring type vibration sensor 95 is located along an X-axis which is perpendicular to the hitting direction (along a Z-axis shown in FIGS. 3 and 4) toward a gold ball 90 hit by a golfer, the spring type vibration sensor 95 will swing back and forth so that it will contact with the metal hollow tube 92 several times. Meanwhile, one or more contacting signals will pass to the controller 93 and then the light bulb 94 will emit light.

However, the conventional light emitting golf ball still has the following disadvantages.

[1] Some specific hitting directions cannot work. As shown in FIGS. 5 and 6, if the spring type vibration sensor 95 is located along the Z-axis and the hitting direction toward the golf ball 90 is also along the same axis (that is the Z-axis as illustrated in FIGS. 5 and 6), the spring type vibration sensor 95 will vibrate axially without contacting with the metal hollow tube 92 (forming an open loop that equals to the switch OFF). So, the light bulb 94 will not emit any light. When the golf ball is hit from some specific hitting directions, it is possible that it cannot emit light.

[2] The product is easy to be damaged during the high temperature injection process. When the golf ball is formed by a plastic injection method, the temperature is usually higher than 150° C. Under this condition, the soldered portions on the circuit board might melt out and cause the corresponding electronic elements out of order. In addition, during the high temperature plastic injection process, the metal hollow tube 92 is easy to be filled with some injected material inside the tube entirely or partially. Thus, the spring structure might be jammed, blocked, bent or damaged (such as forming a short circuit or cannot vibrate anymore). Hence, the defective rate of this product is very high. It definitely jeopardizes the value of this product in a commercial market.

SUMMARY OF THE INVENTION

The primary object of the present invention is to provide an acoustic wave induced light emitting golf ball. It is irrelevant to the hitting direction.

The next object of the present invention is to provide an acoustic wave induced light emitting golf ball. It has an extremely low defective rate.

Another object of the present invention is to provide an acoustic wave induced light emitting golf ball. In which, the product life can be prolonged.

DETAILED DESCRIPTION OF THE PREFERRED EMBODIMENT

Figure 1:
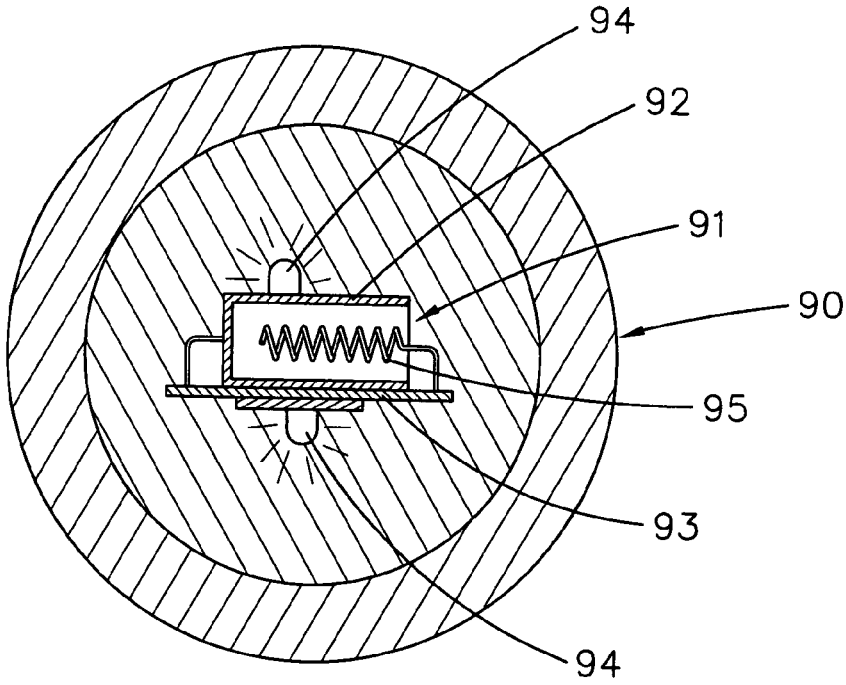
FIG.1 (PRIOR ART)
FIG. 1 is a cross-sectional view of a conventional light emitting golf ball.
Figure 2:
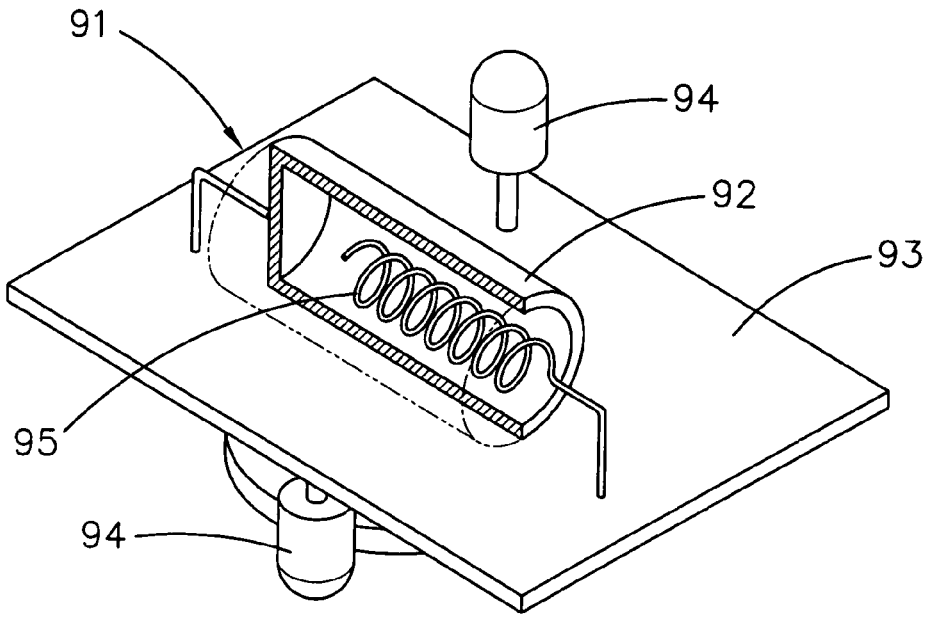
FIG.2 (PRIOR ART)
FIG. 2 is a perspective view illustrating a portion of the conventional light emitting golf ball.
Figure 3:
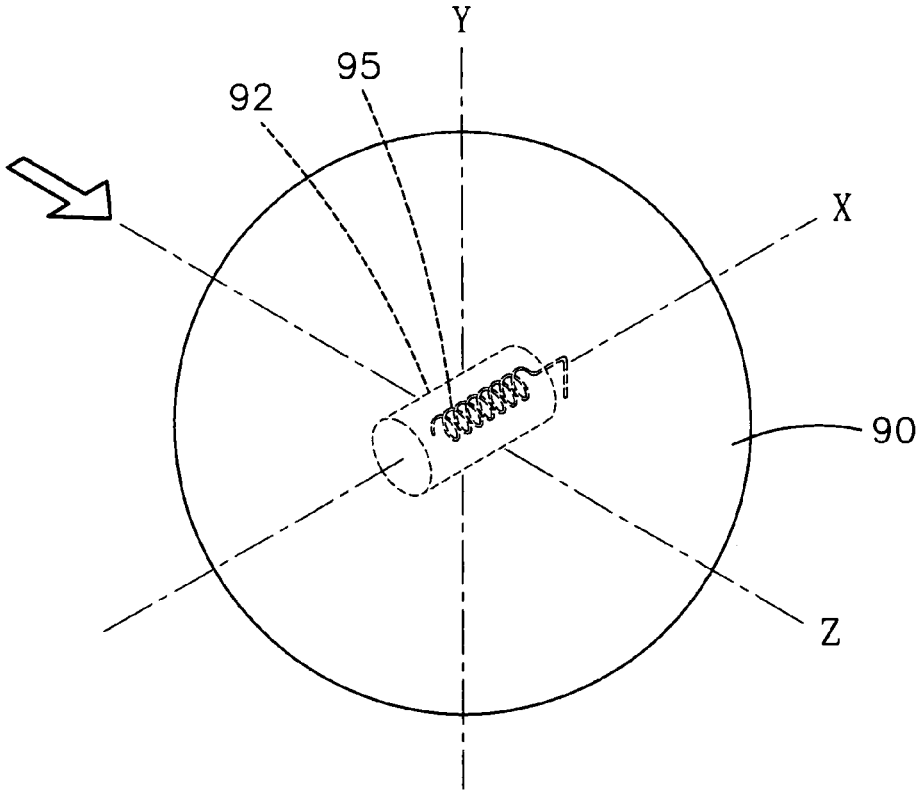
FIG.3 (PRIOR ART)
FIG. 3 illustrates one hitting direction of the conventional light emitting golf ball.
Figure 4:
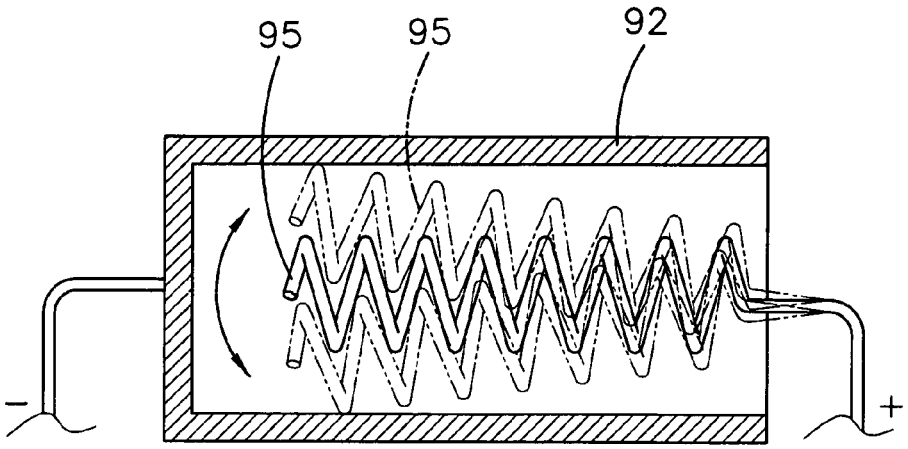
FIG.4 (PRIOR ART)
FIG. 4 is a cross-sectional view of one vibrating condition of the conventional light emitting golf ball.
Figure 5:
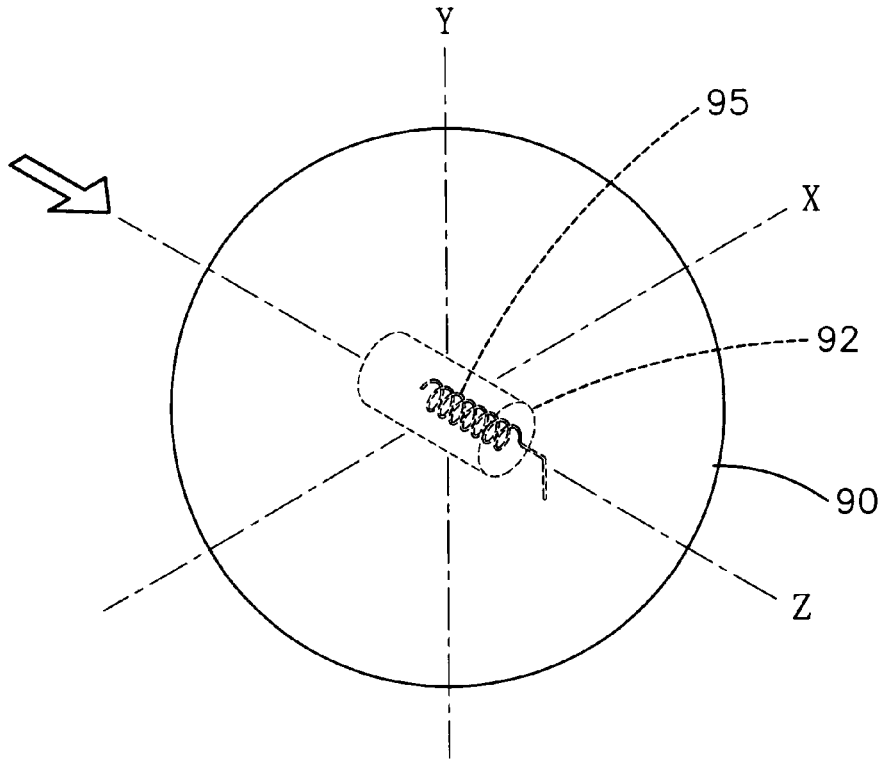
FIG.5 (PRIOR ART)
FIG. 5 illustrates another hitting direction of the conventional light emitting golf ball.
Figure 6:
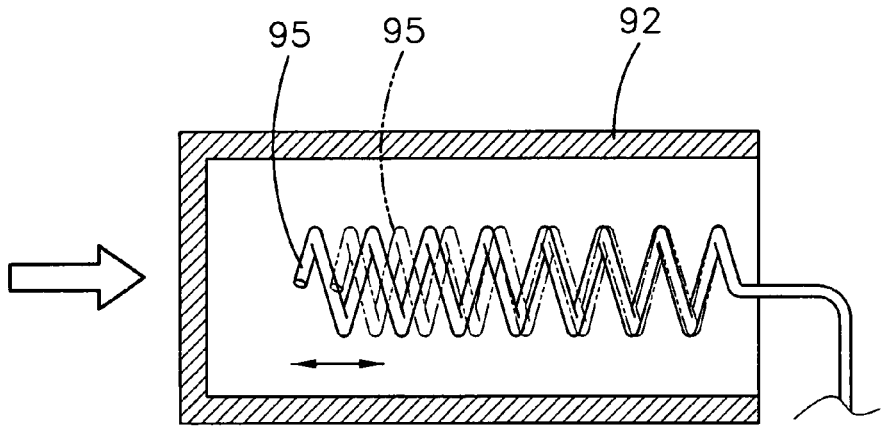
FIG.6 (PRIOR ART)
FIG. 6 is a cross-sectional view of another vibrating condition of the conventional light emitting golf ball.
Figure 7:
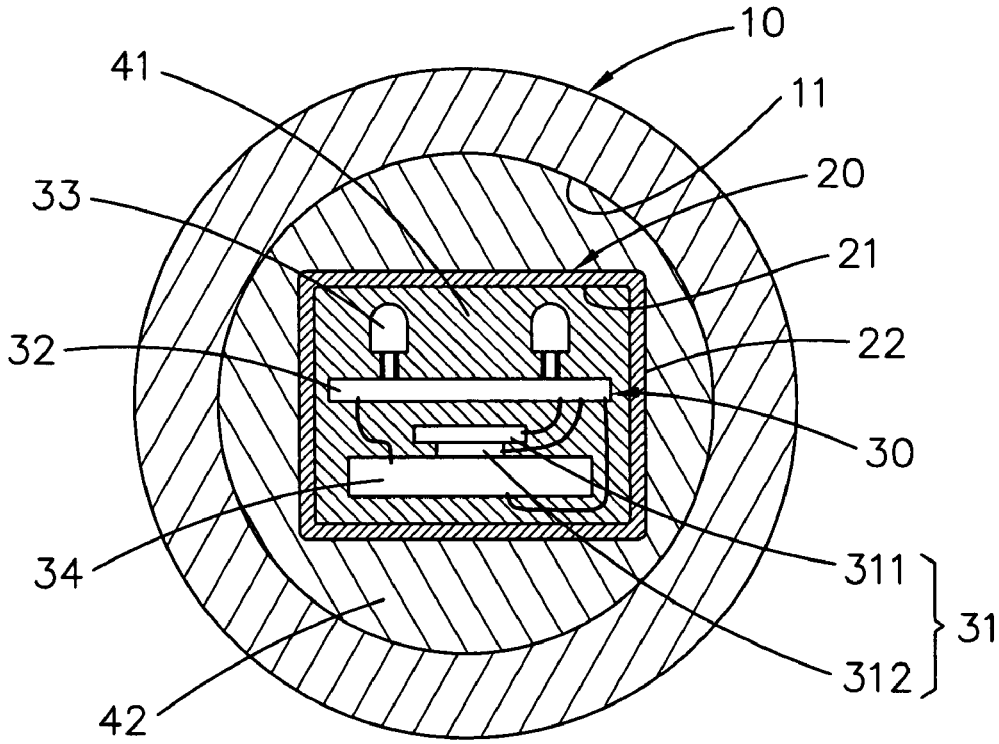
FIG. 7 is a cross-sectional view of the present invention.
Figure 9:
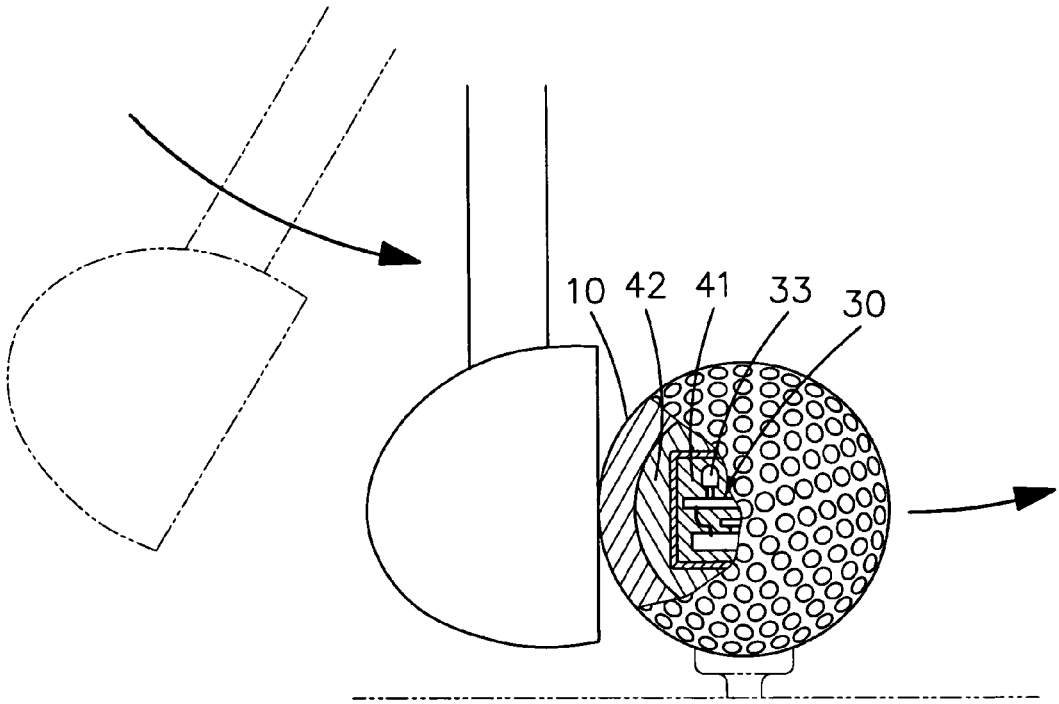
FIG. 9 is a view showing the present invention hit by a gold club.

Referring to FIG. 7, the present invention is an acoustic wave induced light emitting golf ball. It comprises:

a spherical housing 10 having an internal space 11;

a fixing container 20 having an inner surface 21 and an outer surface 22, the fixing container 20 being disposed in the internal space 11 and being light transmittable;

a light emitting device 30 disposed in the fixing container 20, the light emitting device 30 including an acoustic wave sensor 31, a controller 32, at least one light emitting element 33, and an electricity supplier 34 (such as a small battery); when the acoustic wave sensor 31 receiving an external acoustic wave signal higher than a predetermined value (for example, while hitting the spherical housing 10 and then generating an acoustic wave signal as shown in FIG. 9), the acoustic wave sensor 31 sending out an activating signal to the controller 32 so that at least one light emitting element 33 emits light;

a first fitting portion 41 disposed between the light emitting device 30 and the inner surface 21 of the fixing container 20, the first fitting portion 20 (such as a general AB glue) being hardened at a room temperature and being light transmittable;

a second fitting portion 42 disposed between the spherical housing 10 and the outer surface 22 of the fixing container 20, the second fitting portion 42 (such as a plastic injection material) being hardened at a relative high temperature (such as over 100° C.) and being light transmittable.

Furthermore, after the first fitting portion 41 (covering the light emitting device 30) has hardened under a room temperature for a while, this light emitting device 30 can be firmly secured inside the fixing container 20. After which, the second fitting portion 42 is injected under a relative high temperature. Then, it is cooled down and becomes hardened gradually. Although the second fitting portion 42 is a high-temperature injection material, the light emitting device 30 is protected by the first fitting portion 41 so that the light emitting device 30 will not be damaged due to such high temperature. Therefore, the first fitting portion 41 has the following two unique functions:

[a] It can firmly secure the light emitting device in the fixing container. The hardened first fitting portion 41 can firmly secure the light emitting device 30 in the fixing container 20. The electronic parts of the light emitting device 30 do not loose, even though the golf ball receives a huge shock or a strong impact (by a golf player). Thus, the life of this invention can be prolonged.

[b] It forms a thermal insulating layer. Because the first fitting portion 41 wraps around the entire light emitting device 30, it can block the heat transferred from the second fitting portion 42 during the high temperature injection process. Therefore, the defective rate can be significantly reduced.

Figure 10:
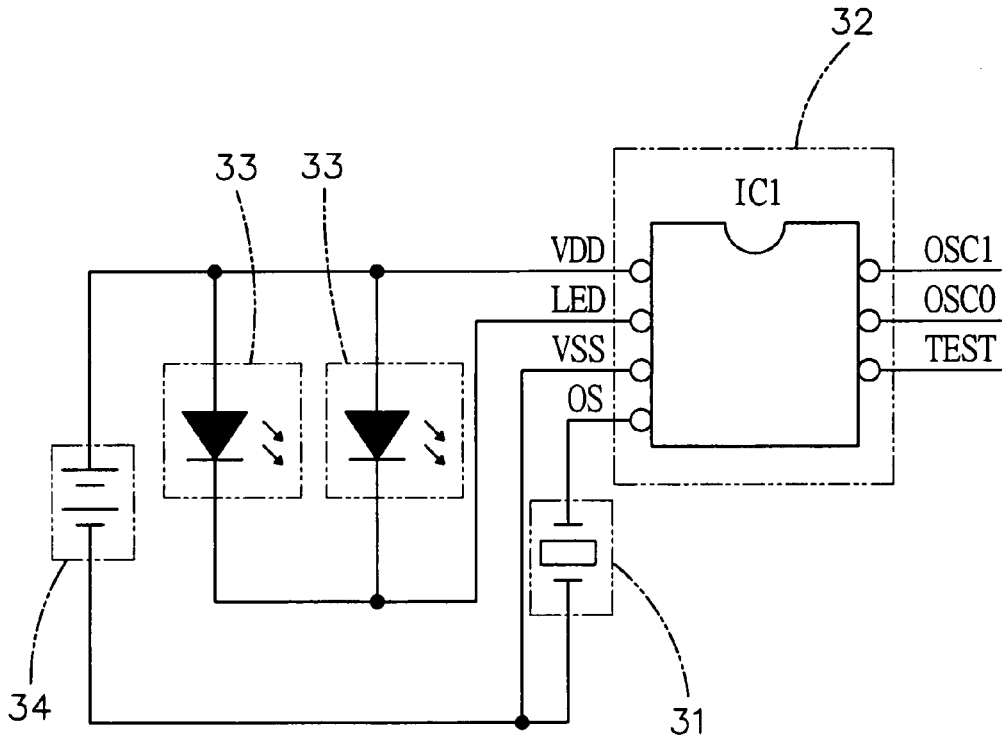
FIG. 10 is a simplified circuit diagram of the present invention.

In addition, as illustrated in FIG. 10, it shows the simplified circuit.

Figure 8:
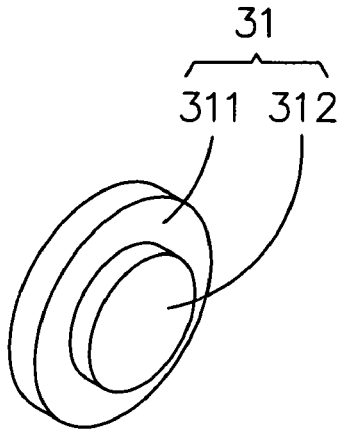
FIG. 8 illustrates the acoustic wave sensor of the present invention.

The acoustic wave sensor 31 can be a piezoelectric ceramic element (such as a piezoelectric ceramic buzzer). It is consists of a copper plate 311 and a piezoelectric ceramic plate 312 (as shown in FIG. 8). The piezoelectric ceramic plate 312 has a piezoelectricity. When it receives an external acoustic wave signal higher than a predetermined value, such as approximately 121.0 kHz (of course the value can be adjusted), the acoustic wave sensor 31 sends out an activating signal to the controller 32 so that at least one light emitting element 33 emits light. If it does not exceed the value, no action will occur. Thus, the light emitting operation is irrelevant to the direction of the hitting force.

The advantages and functions of the present invention can be summarized as follows:

[1] It is irrelevant to the hitting direction. In this invention, it utilizes an acoustic wave sensor to determine whether the golf club hits the golf ball or not. When the golf club hits the golf ball, it suddenly generates a strong sound (accompanying a hitting shock wave). When the acoustic wave sensor receives an external acoustic wave signal higher than a predetermined value, the acoustic wave sensor sends out an activating signal to the controller so that at least one light emitting element emits light. No matter which hitting direction, the present invention can work fine.

[2] It has an extremely low defective rate. Due to the first fitting portion hardened under a room temperature for a while, the light emitting device is firmly secured and well protected inside the fixing container. After which, the heat will not damage the light emitting device during the high temperature injection process for the second fitting portion inside the spherical housing. Therefore, the function of the final product is stable. Hence, it has an extremely low defective rate.

[3] The product life can be prolonged. The light emitting device is surrounded by the first fitting portion, by the fixing container and then by the second fitting portion. So, the structure this invention is very solid. It can afford more impact (hitting force). Thus, the product life can be prolonged.

The above embodiments are only used to illustrate the present invention, not intended to limit the scope thereof. Many modifications of the above embodiments can be made without departing from the spirit of the present invention.

What is claimed is:

1. An acoustic wave induced light emitting golf ball comprising:

a spherical housing having an internal space;

a fixing container having an inner surface and an outer surface, said fixing container being disposed in said internal space and being light transmittable;

a light emitting device disposed in said fixing container, said light emitting device including an acoustic wave sensor, a controller, at least one light emitting element, and an electricity supplier; when said acoustic wave sensor receives an external acoustic wave signal higher than a predetermined value, said acoustic wave sensor sends out an activating signal to said controller so that at least one light emitting element emits light;

a first fitting portion disposed between said light emitting device and the inner surface of said fixing container, said first fitting portion being hardened and light transmittable;

a second fitting portion disposed between said spherical housing and the outer surface of said fixing container, said second fitting portion being hardened and light transmittable.

2. The acoustic wave induced light emitting golf ball as claimed in claim 1, wherein said acoustic wave sensor is a piezoelectric ceramic element including a copper plate and a piezoelectric ceramic plate; and said predetermined value is approximately 121.0 kHz.

* * * * *